US006041774A

United States Patent [19]

Ward et al.

[11] Patent Number: 6,041,774

[45] Date of Patent: Mar. 28, 2000

[54] OVERHEAD VENTILATION SYSTEM FOR USE WITH A COOKING APPLIANCE

[75] Inventors: John M. Ward, Harrison Township; Gregory Kolecki, Ann Arbor, both of Mich.

[73] Assignee: EVS, Inc., Birmingham, Mich.

[21] Appl. No.: 09/191,184

[22] Filed: Nov. 13, 1998

[51] Int. Cl.[7] ..... F24C 15/20

[52] U.S. Cl. ..... 126/299 D; 126/299 R

[58] Field of Search ..... 126/299 D, 299 R, 126/299 F; 55/DIG. 36

[56] References Cited

U.S. PATENT DOCUMENTS

| | | | |
|---|---|---|---|
| 3,858,568 | 1/1975 | Seidel . | |
| 3,952,640 | 4/1976 | Kuechler . | |
| 3,978,777 | 9/1976 | Nett | 126/299 D |
| 4,011,802 | 3/1977 | Molitor et al. . | |
| 4,085,736 | 4/1978 | Kuechler | 126/299 D |
| 4,129,121 | 12/1978 | Dorius . | |
| 4,250,870 | 2/1981 | Kuechler . | |
| 4,266,529 | 5/1981 | Gaylord . | |
| 4,286,572 | 9/1981 | Searcy et al. . | |
| 4,346,692 | 8/1982 | McCauley . | |
| 4,373,509 | 2/1983 | Neitzel et al. . | |
| 4,483,316 | 11/1984 | Fritz et al. . | |
| 4,484,563 | 11/1984 | Fritz et al. . | |
| 4,541,409 | 9/1985 | Karst et al. . | |
| 4,586,486 | 5/1986 | Kaufman . | |
| 4,616,562 | 10/1986 | Kuechler . | |
| 4,887,587 | 12/1989 | Deutsch | 126/299 D |
| 4,896,657 | 1/1990 | Glassman . | |
| 4,944,285 | 7/1990 | Glassman . | |
| 5,299,557 | 4/1994 | Braithwaite et al. . | |
| 5,467,761 | 11/1995 | Kuechler . | |
| 5,603,557 | 2/1997 | Marks et al. | 312/265.6 |
| 5,673,681 | 10/1997 | Neitzel et al. . | |
| 5,713,346 | 2/1998 | Kuechler . | |
| 5,906,195 | 5/1999 | Georgaras | 126/299 D |

*Primary Examiner*—Ira S. Lazarus
*Assistant Examiner*—Sara Clarke
*Attorney, Agent, or Firm*—Gifford, Krass, Groh, Sprinkle, Anderson & Citkowski, P.C.

[57] ABSTRACT

An overhead ventilation hood for a ventilation system of a conventional cooking appliance. The hood includes a housing with a planar base surface and a recessed interior arrayed in a downwardly facing manner which is defined by a first side, a second spaced apart side, a first interconnecting end and a second interconnecting end. Intake and exhaust openings are formed through the housing proximite the first and second sides. The ventilation system includes a first blower mounted in communication with a first length of ductwork extending to the intake opening to provide a stream of pressurized intake air and a second blower mounted in communication with a second length of ductwork extending from the exhaust opening to provide a stream of pressurized exhaust air. A supply plenum chamber is established along the first side of the housing interior and includes elongate and planar shaped channeling walls and a planar shaped diffuser for regulating a flow of the stream of pressurized air into a central open interior of the housing. An exhaust plenum chamber is established along the second side of the housing interior and includes an elongate planar shaped and angularly mounted filter. Combinations of heat, airborne grease and smoke are issued upwardly from the cooking appliance within the open interior of the hood and are discharged through the filter and within the stream of exhaust air concurrent with intermixing with the regulated flow of the stream of intake air. An elongate and planar shaped deflector extends in proximity to a bottom edge of the angularly disposed filter at a further specified angular orientation and causes a deflected stream of exhaust air to be redirected towards the filter for evacuation from the housing.

16 Claims, 3 Drawing Sheets

OVERHEAD VENTILATION SYSTEM FOR USE WITH A COOKING APPLIANCE

BACKGROUND OF THE INVENTION

1. Field of the Invention

The present invention relates generally to overhead ventilation systems for use with ovens and other cooking appliances and, more particularly, to a ventilator hood for removing heat, airborne grease and smoke from such cooking appliances while creating an airflow equilibrium within the hood so as to minimize the loss of quality interior air.

2. Description of the Prior Art

The prior art is well documented with ventilation hoods utilized in ventilation systems for facilitating the removal of heat, airborne grease and smoke from the cooking devices, and in particular commercial cooking equipment such as ranges, pizza ovens and the like. The objective of each such ventilation system is the ability to evacuate the undesirable by-products of the cooking appliance in such a manner so as not to affect the air quality established within the room enclosure surrounding the oven. This is preferably accomplished by providing a separate air inlet to the ventilation hood in addition to the exhaust outlet in the attempt to achieve an air equilibrium condition within the hood so as not to evacuate the quality conditioned (heated or cooled) air within the hood.

U.S. Pat. No. 5,713,346, issued to Kuechler, discloses an exhaust hood ventilating system which utilizes both intake and exhaust blowers and means for regulating the volume of air introduced within the ventilation hood. Additional means are disclosed for creating a vortex flow within the hood enclosure and for diverting outdoor intake air into a surrounding kitchen area for ventilation before it is passed back to the hood for exhaust to the outdoors.

U.S. Pat. No. 5,467,761, also issued to Kuechler, teaches a further variation of a filtering apparatus in which a supply air plenum is provided with perforated balancing plates and deflector plates which perform the functions of modulating an incoming air flow. A filter is arrayed in proximity to an exhaust of the apparatus to facilitate removal of the by-products of appliance.

U.S. Pat. Nos. 4,944,285 and 4,896,657, both issued to Glassman, teach variations of an exhaust hood for a pizza oven which induces exhaust materials into the exhaust stream by creating high velocity flow of outside air into the hood. According to the '285 patent, an intake fan forces outside air into a pair of intake plenums located along opposite sides of the hood, creating two high velocity air streams flowing toward a central exhaust plenum and an exhaust fan drawing air into the exhaust plenum and through inclined grease filters. According to the '657 patent, a central intake fan forces outside air into a central intake plenum and through air deflectors to redirect opposite extending air streams through exhaust plenums on opposite sides of the hood. Exhaust fan draw air into the exhaust plenums and through inclined grease filters.

A shortcoming of the prior art is the inability to create a controlled equilibrium environment within a ventilation hood assembly for facilitating the evacuation of heat, airborne grease, smoke and odors emitted from the cooking appliance while at the same time preventing the loss of quality interior conditioned air through the hood exhaust or the substantial introduction of outside supply air past the hood enclosure and within the room interior.

SUMMARY OF THE PRESENT INVENTION

The present invention is an overhead ventilation hood for use within a ventilation system for a cooking appliance. The ventilation system includes a first blower mounted in communication with a first length of ductwork extending to the hood and a second blower mounted in communication with a second length of ductwork extending from the hood. The hood includes a housing having a planar shaped base secured at an elevated location above the cooking appliance, the housing having a recessed interior which is arrayed in a downwardly facing manner and which is defined by a first side, a second spaced apart side, a first interconnecting end and a second interconnecting end.

An intake opening is formed through the housing base proximate the first side and is secured to the first length of ductwork for receiving a first stream of pressurized intake air. An exhaust opening is formed through the housing proximate the second side and is secured to the second length of ductwork for exhausting a second stream of pressurized exhaust air.

A supply plenum chamber is established within the recessed interior of the hood enclosure along the first side and is constructed of first and second elongate and planar shaped channeling walls which are interconnected by a planar and elongate diffuser including a plurality of individual apertures formed therethrough for regulating a flow of the first stream of intake air within the central open interior. An elongate and arcuate shaped air flow distribution element is mounted upon the second planar shaped channeling wall and functions to cause the first stream of pressurized intake air to be equally distributed between the first and second interconnecting ends within the supply plenum chamber prior to passing through the diffuser.

An exhaust plenum chamber is established within the recessed interior along the second side and includes an elongate and planar shaped filter which extends between the interconnecting ends and which is mounted by first and second opposed and elongate brackets in an angular orientation relative to the second side. The filter, like the rest of the hood enclosure, is constructed of an aluminized steel or stainless steel material and includes first and second pluralities of individual and parallel extending baffle members which are offset relative to one another and which are secured within a surrounding frame. Each of the baffle members further include in cross section a first leg and a second angularly extending leg and, in operation, the filter effectively removes such contaminants as airborne grease and other objects from the exhausted air stream. The second and lower elongate bracket further includes a trough which collects the grease and other contaminants through apertures in the bottom of the filter which are then emptied into a removable grease tray which is releasably secured to the housing proximate a forward location along the second side.

An elongate and planar shaped deflector extends in proximity to a bottom edge of the filter at a further specified angular orientation relative to the second side. The deflector functions to cause a further deflected stream of exhaust air from the filter, which would otherwise escape from the hood enclosure into the room interior, to be redirected towards the filter for evacuation from the housing, thus increasing the efficiency of the hood.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
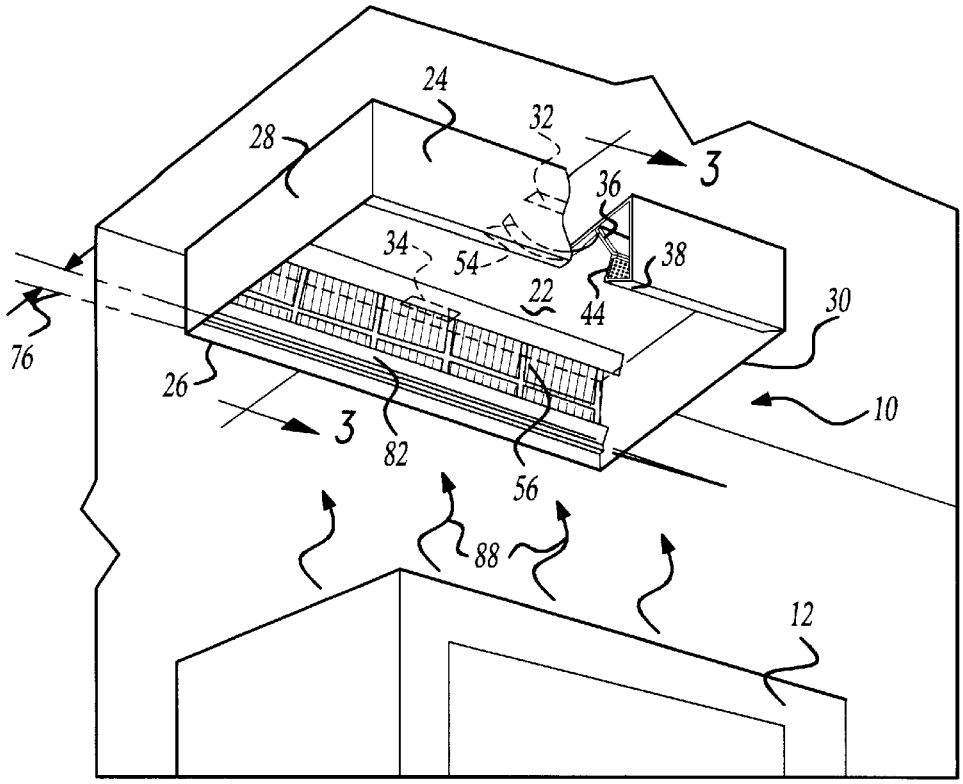
FIG. 1 is an environmental view illustrating the overhead ventilation hood for use within a ventilation system for a conventional cooking appliance according to the present invention.
Figure 2:
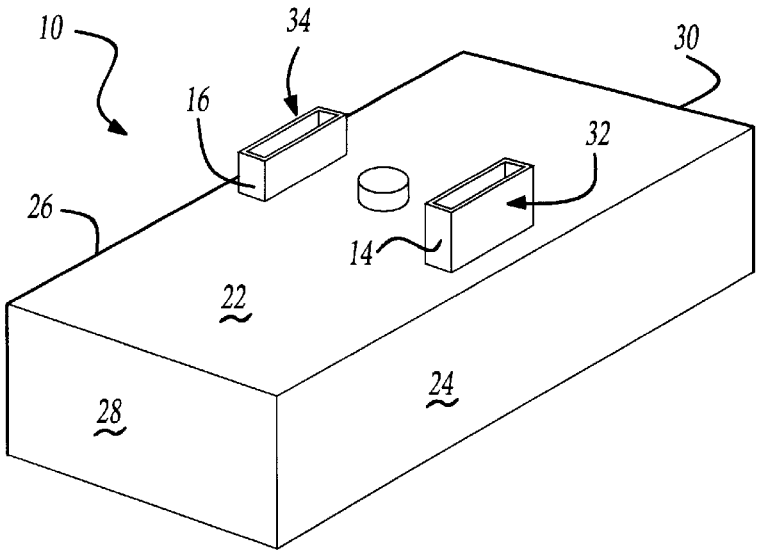
FIG. 2 is a perspective view of the ventilation hood as shown in FIG. 1.

Referring now to FIG. 1, an overhead ventilation hood is shown at 10 for use within a ventilation system for a conventional cooking appliance 12 according to the present invention. The types of cooking appliances 12 with which the hood 10 may be utilized include pizza ovens, other types of ranges, fryers and just about any other type of commercial appliance which produces a significant level of smoke, heat, airborne grease and odors for which it is desired to evacuate from within an enclosed area.

The ventilation hood 10 is incorporated within an overall ventilation system, such system including a first blower (not shown) of conventional construction and mounted in communication with a first length of ductwork 14 (see FIG. 3) extending to the hood 10 at a first location and a second blower or exhausting fan (likewise not shown) mounted in communication with a second length of ductwork 16 (again see FIG. 3) extending from the hood at a second location. The ductwork is typically aluminum, carbon steel, stainless steel or other lightweight metal composite suitable for use in the industry. The blowers are typically mounted at a rooftop location above the room enclosure within which the hood 10 is situated and function to introduce a first stream of pressurized intake air 18 through the first length of ductwork 14 and to evacuate a second stream of pressurized exhaust air 20 through the second length of ductwork 16. As will be subsequently described in more detail, the purpose of the intake air 18 is to establish an equilibrium state within the hood enclosure so the quality air within the room enclosure (heated or air conditioned air) is not evacuated with the exhaust air stream 20. The ideal construction of the present invention further prevents the unconditioned or unheated outside supply air from escaping the hood enclosure and intermixing with the quality air within the room.

Referring again to FIG. 1, the hood 10 is constructed of an aluminized steel or stainless steel housing having a planar shaped base 22 which is adapted to be secured at an elevated location above the cooking appliance 12, such as by heavy duty hangers anchored to the ceiling or by other conventional securing means. The housing includes a recessed interior which is arrayed in a downwardly facing manner and forms a substantially rectangular shape which is defined by a first side 24, a second spaced apart side 26, a first interconnecting end 28 and a second interconnecting end 30. An intake opening 32 is formed through the housing base 22 proximate the first side 24 and is secured to the first length of ductwork 14 for receiving the first stream of intake air 18 and a further intake opening 34 is formed through the housing base 22 proximate the second side 26 and is secured to the second length of ductwork 16 for receiving the second stream of exhaust air 20.

A supply plenum chamber is established within the recessed interior of the housing an along the first side 24 and includes a first elongate and planar shaped channeling wall 36 extending in an inwardly and downwardly angled direction towards the first side 24 and a second elongate and planar shaped channeling wall 38 extending from the first side 24 in an upwardly and outwardly angled direction. According to the preferred embodiment, the first channeling wall 36 extends at a 30 degree angle relative to the first side 24 (see at 40 in FIG. 3) and the second channeling wall 38 extends at a further 75 degree angle relative to the first side 24 (see at 42).

An elongate and planar shaped diffuser 44 is secured at opposite ends thereof to the exposed ends of the first and second planar shaped channeling walls 36 and 38 (such as by welding or the like) and, along with the first and second planar shaped channeling walls, extend the distance between the first and second interconnecting ends 28 and 30 so as to enclose the space defined by the supply plenum chamber. As best viewed in cross section, the diffuser 44 extends in a reverse angular fashion relative to the first and second planar shaped channeling walls 36 and 38 and so that it adopts a slight inward and angular configuration 46 (preferably in the range of 10 to 20 degrees) relative to a vertical axis parallel to the first wall 24. Depending upon the specified width configuration of the channeling walls 36 and 38, as will be further discussed, the angular range of the diffuser 44 may be further modified to suit a particular application.

Figure 3:
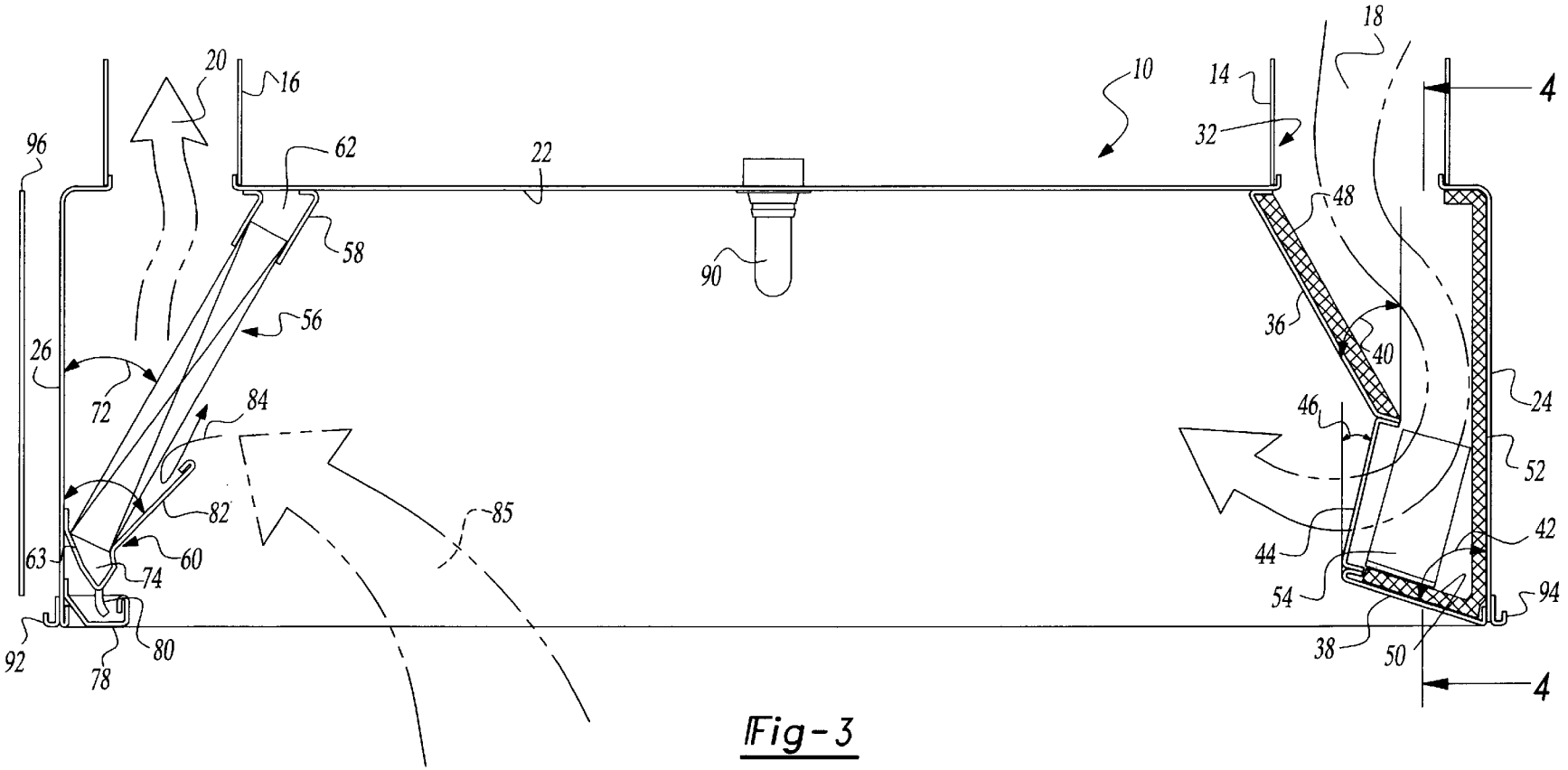
FIG. 3 is a cutaway view taken along line 3—3 of the overhead ventilation hood shown in FIG. 1 and illustrating the supply plenum chamber and the exhaust plenum chamber forming portions of the present invention.
Figure 4:
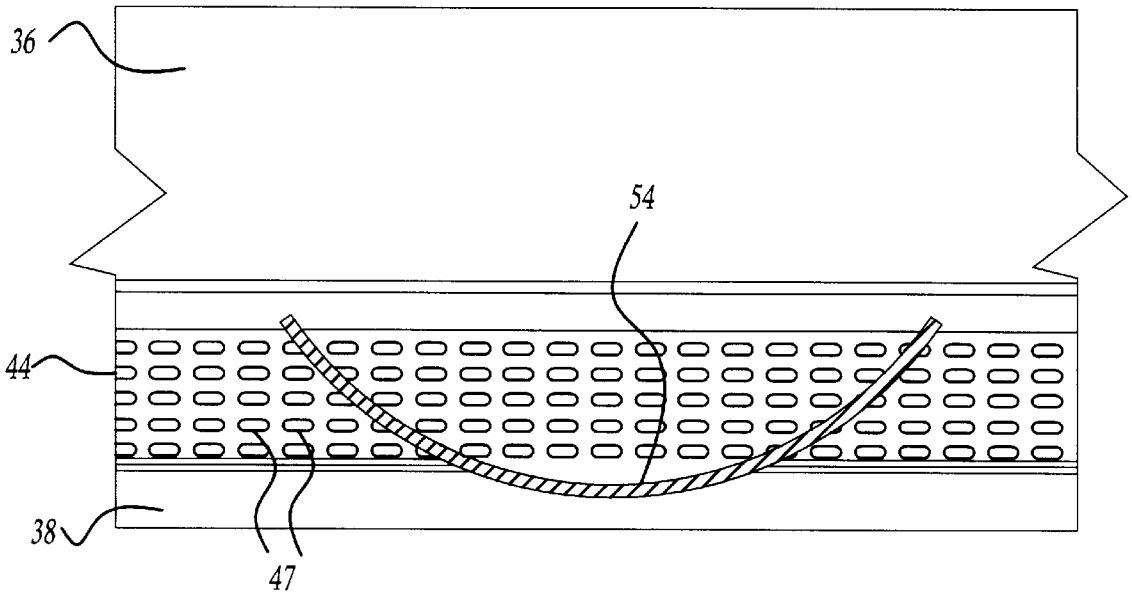
FIG. 4 is a cutaway view taken along line 4—4 of FIG. 3 and illustrating the elongate diffuser and arcuate shaped air flow distribution element forming portions of the supply plenum chamber according to the present invention.

The diffuser 44, similar to the channeling walls 36 and 38, is constructed of an aluminized steel or stainless steel material and includes a planar face within which are formed a plurality of individual apertures. As best shown in FIG. 4, the apertures 47 are preferably oblong holes which run the full length of the diffuser (preferably less 12 inches at each end) and the full height so as to define a pass-through location for permitting the intake air stream to flow therethrough in a desired regulating fashion. The individual apertures 47 formed by the oblong holes in the diffuser 44 preferably consist of between 50% and 75% or more of the open area defined by the planar face of the diffuser and the quantity and placement of the apertures is determined so as to provide for a desired level of regulated flow through the supply plenum chamber and into the hood enclosure. As best shown in FIG. 3, the intake stream 18 is illustrated passing through the supply plenum chamber and into a central open interior of the housing. As is also shown at 48, 50 and 52, layers of insulation (preferably an inch thick) are layered over the first channeling wall 36, second channeling wall 38 and first extending side 24, respectively, and the insulation assists in provides a barrier to temperature variation between the supply air flow 18 prior to it being introduced to the hood enclosure interior.

An elongate and arcuate shaped air flow distribution element 54 is secured upon the second channeling wall 38 and extending in a longitudinal direction towards the opposite and first and second extending and interconnecting ends 28 and 30. As is best shown in FIG. 4, the arcuate shaped distribution element 54 has flattened upper and lower surfaces and forms a continuous curved shape which functions to cause the first stream of intake air 18 to be equally distributed along the supply plenum chamber between the first and second interconnecting ends and so as to further provide for even regulated flow through the diffuser element 44.

Referring again to FIG. 3, an exhaust plenum chamber is established within the interior of the hood enclosure and along the second extending side 26. The exhaust chamber is defined in large part by an elongate and planar shaped filter 56 which extends between the first and second interconnecting sides 28 and 30 and which is secured to the housing interior by a first upper and elongate bracket 58 and a second lower, spaced apart and opposingly facing, bracket 60. The first bracket 58 defines a first inwardly facing channel 62 and the second bracket 60 substantially defines a second inwardly facing channel 63 for receiving opposite engaging ends of the filter 56.

Figure 5:
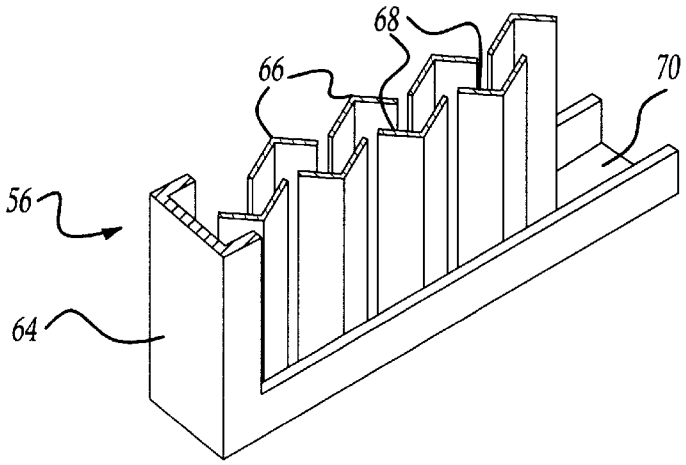
FIG. 5 is a cutaway view of the filter forming a portion of the exhaust plenum chamber and further illustrating the pluralities of spaced apart baffle members for filtering impurities from the exhausted air flow.

As is further best illustrated in the sectioned view of FIG. 5, the filter 56 is constructed of an aluminum or stainless steel material and particularly includes an encircling frame 64 which secures and supports a first plurality of individual and parallel extending baffle members 66 and a second spaced apart plurality of individual and parallel extending baffle members 68. The pluralities of baffle members 66 and 68 may be secured to the frame 64 by welding or other conventional attachment means as are known in the art and each individual baffle member 66 and 68 includes in cross section a first leg and a second angularly extending leg as is clearly illustrated. The purpose of the baffle members is to provide a circuitous path for the exhaust stream 20 as it passes through to the exhaust plenum chamber and out through the second length of ductwork 34 to facilitate the collection of airborne particles from the exhaust stream, such typically including airborne grease and other contaminants. For this purpose, the bottom of the frame 64 may be open in whole or in part (see at 70) to facilitate the pass through of the grease through the bottom of the filter 56 and an explanation of the ability to collect and reposit the airborne contaminants will be described below.

Referring again to FIG. 3, the filter 56 is illustrated in a releasably mounted fashion within the hood enclosure interior in an upwardly and outwardly extending and specified angular orientation 72 relative to a vertical axis extending through the second side 26. Preferably the filter 56 extends at a thirty degree orientation relative to the vertical and encloses a substantially triangular shaped area which defines the exhaust plenum chamber. The second and lower extending bracket 60 further defines, beneath the second inwardly facing channel 63 for receiving the bottom locating edge of the filter 56, a lower collection trough 74 which is capable of collecting the airborne grease and other contaminates from the stream of exhaust air (via the filter 56). As is illustrated in FIG. 1, the lower bracket 60 with collection trough 74 preferably is angled to a minor degree off the horizontal axis, as shown at 76, towards a forward end of the second side 26 and in proximity to the first interconnecting end 28. Referring back to FIG. 3, a grease collection tray 78 is releasably secured to the housing proximate the forward and interconnecting location of the second side 26 with the first interconnecting end 28 and beneath a communicating opening 80 in the trough 74 (and which represents the lowermost position of the trough) for collecting the grease captured by the filter 56.

As is best shown in FIG. 3, an elongate and planar shaped deflector 82 extends in proximity to a bottom edge of the filter 56 and, according to the preferred embodiment, is secured to the second and lower extending bracket 60 and is removable for cleaning. The deflector 82 extends substantially the length of the exhaust plenum chamber but is of a much smaller width as opposed to the filter 56. The deflector 82 extends at a further specified angular orientation relative to a vertical plane, as illustrated by directional arrow 85, and in the preferred embodiment extends at a forty-five degree angle relative to the vertical plane defined by the second side 26 of the housing.

The purpose of the deflector 82 is to capture a deflected portion 84 of an exhaust stream 86 from the filter 56 surface before the deflected portion 84 of the stream has an opportunity to escape from the hood enclosure and to redirect the deflected portion 84 back through the filter 56 for more complete exhausting of the heat, smoke, airborne grease, odors and other undesirable by-products of the cooking device (as illustrated by the directional arrows 88 in FIG. 1) and for which it is desirable to evacuate from the room enclosure. A light fixture 90 may also be secured at a generally centralized location to the base surface 22 of the hood enclosure to provide a desired degree of illumination within the enclosure interior.

In specific preferred embodiments, the overall dimensions of the rectangular hood enclosure include the first and second sides, the diffuser and channeling walls, the filter element, and the deflector (which form portions of the supply plenum and exhaust plenum chambers), and the interconnecting ends being established at such lengths as 7'6", 9'0" and 10'0" to accommodate cooking devices, and particularly pizza ovens, of differing dimensions. It is further envisioned that any hood length between 4'0" and 16'0" may be employed according to the present invention. The overall depth of the sides and interconnecting ends may also vary, but a standard 2.0 feet has been found to be sufficient for accomplishing the necessary air mixing, filtration and removal according to the objectives of the present invention for evacuating the by-products of the cooking process with minimal disturbance to the internal equality condition of the air in the room enclosure. Additionally, trim panels (see 96) may be installed through the provision of J-hooks 92 and 94 (with additional hooks not shown for the first and second ends). The hooks 92 and 94 support corresponding bottom edges of the decorative panels for ease of installation. Upper ends of the trim panels are further secured against the exterior faces of the sides and ends of the hood by any conventional means known in the art.

Having described our invention, it will become apparent that it discloses a novel and improved hood for use within a ventilation system which is an improvement over the prior art devices. Additional embodiments will become apparent to those skilled in the art to which it pertains without deviating from the scope of the appended claims.

We claim:

1. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends, said diffuser regulating a flow of said first stream of pressurized air into a central open interior of said housing;

an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side; and an elongate and planar shaped deflector extending in proximity to a bottom edge of said filter and at a further specified angular orientation relative to said second side so that said deflector extending in a partially overlapping fashion relative to said filter;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing, said deflector causing a further deflected stream of exhaust air to be redirected towards said filter for evacuation from said housing.

2. The overhead ventilation hood according to claim 1, said first elongate and planar shaped channeling wall extending at a 30 degree angle relative to a said first side.

3. The overhead ventilation hood according to claim 1, said second elongate and planar shaped channeling wall extending at a 75 degree angle relative to said first side.

4. The overhead ventilation hood according to claim 1, said supply plenum chamber further comprising an elongate and arcuate shaped air flow distribution element mounted upon said second planar shaped channeling wall, said arcuate shaped distribution element causing said first stream of pressurized intake air to be equally distributed between said first and second interconnecting ends within said supply plenum chamber prior to passing through said diffuser.

5. The overhead ventilation hood according to claim 1, said supply plenum chamber further comprising a layer of insulation secured to interiorly facing surfaces of said first and second planar shaped channeling walls and said first side.

6. The overhead ventilation hood according to claim 1, said elongate and planar shaped diffuser further comprising a plurality of individual apertures formed therethrough.

7. The overhead ventilation hood according to claim 6, said plurality of individual apertures further comprising a plurality of oblong holes which define an open area through said diffuser in a range of between 50% to 75%.

8. The overhead ventilation hood according to claim 1, said elongate and planar shaped filter further comprising a first plurality of individual and parallel extending baffle members and a second spaced apart plurality of individual and parallel extending baffle members which are offset relative to said first plurality of baffle members, said first and second pluralities of baffle members being secured within a surrounding frame.

9. The overhead ventilation hood according to claim 8, said first and second pluralities of baffle members each further comprising in cross section a first leg and a second angularly extending leg.

10. The overhead ventilation hood according to claim 1, further comprising a light fixture mounted to said base surface and extending within a central location of said housing.

11. The overhead ventilation hood according to claim 1, further comprising J-hooks extending around an exterior periphery of said hood at its lower edge for retaining trim panels.

12. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends, said diffuser regulating a flow of said first stream of pressurized air into a central open interior of said housing, said supply plenum chamber further including a first elongate and planar shaped channeling wall extending in an inwardly and downwardly angled direction towards said first side, a second elongate and planar shaped channeling wall extending from said first side in an upwardly and outwardly angled direction, said elongate and planar shaped diffuser interconnecting at opposite sides to remote extending edges of said first and second channels walls;

an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side; and an elongate and planar shaped deflector extending in proximity to a bottom edge of said filter at a further specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing, said deflector causing a further deflected stream of exhaust air to be redirected towards said filter for evacuation from said housing.

13. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends, said diffuser regulating a flow of said first stream of pressurized air into a central open interior of said housing;

an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side;

a first elongate bracket secured to said base surface and extending between said first and second interconnecting ends, said first bracket defining a first inwardly facing channel for receiving an upper edge of said filter, a second elongate bracket secured to said second side proximate a bottom edge and likewise extending between said first and second interconnecting ends, said second bracket defining a second inwardly facing channel for receiving a corresponding lower edge of said filter, said second elongate bracket further including a collection trough in communication with said second inwardly facing channel, said trough capable of collecting airborne grease filtered from said stream of exhaust air; and an elongate and planar shaped deflector extending in proximity to a bottom edge of said filter at a further specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing, said deflector causing a further deflected stream of exhaust air to be redirected towards said filter for evacuation from said housing.

14. The overhead ventilation hood according to claim 13, further comprising a grease collection tray releasably secured to said housing proximate a forward located interconnecting end and beneath a opening in said trough, a longitudinal axis extending through said trough descending a selected and minimal height relative to a horizontal axis and in a direction towards said forward location to facilitate said collection of filtered grease.

15. The overhead ventilation hood according to claim 13, said filter extending at a thirty degree angle relative to said second side of said housing.

16. The overhead ventilation hood according to claim 15, said deflector extending from said second elongate bracket at a forty-five degree angle relative to said second side of said housing.

* * * * *